United States Patent [19]

Romano

[11] Patent Number: 5,065,462

[45] Date of Patent: Nov. 19, 1991

[54] HANDICAP-ACCESSIBLE RESTROOM

[76] Inventor: Raymond Romano, 314 Park St., West Haven, Conn. 06516

[21] Appl. No.: 608,537

[22] Filed: Nov. 2, 1990

[51] Int. Cl.[5] ..... A47K 4/00; A47K 11/00

[52] U.S. Cl. ..... 4/604; 4/662; 4/663; 52/34; 70/278

[58] Field of Search ..... 4/663, 662, 665, 613, 4/555, 604, 621, 567, 548; 137/624.11; 52/34; 70/278

[56] References Cited

U.S. PATENT DOCUMENTS

| | | | |
|---|---|---|---|
| 1,501,364 | 7/1924 | Orington | 52/34 X |
| 2,565,978 | 8/1951 | Meriwether | 4/571 X |
| 3,810,787 | 5/1974 | Yoeli et al. | 134/172 X |
| 4,210,284 | 7/1980 | Tarnay et al. | 236/93 B |
| 4,345,343 | 8/1982 | Shyman | 4/662 |
| 4,534,194 | 8/1985 | Hydria | 70/278 |
| 4,653,125 | 3/1987 | Porter | 4/663 X |
| 4,706,311 | 11/1987 | Jarosinski | 4/571 X |
| 4,899,402 | 2/1990 | Maynard et al. | 4/613 X |
| 4,921,209 | 5/1990 | Moineau | 137/624.11 X |
| 4,987,619 | 1/1991 | Smith | 4/604 X |

*Primary Examiner*—Daniel M. Yasich

*Attorney, Agent, or Firm*—Bachman & LaPointe

[57] ABSTRACT

A handicap-accessible restroom including shower, sink and commode portions. The shower portion contains a shower head connected to a hose which is of sufficient length to extend to all areas within the restroom, for simplified cleaning. The restroom floor is tapered downward toward drain holes to further simpify cleaning and expedite drying.

18 Claims, 3 Drawing Sheets

HANDICAP-ACCESSIBLE RESTROOM

BACKGROUND OF THE INVENTION

1. Field of the Invention

This invention relates to restroom facilities, and more specifically to a handicap-accessible restroom facility having a shower, toilet and sink including a shower head suited for simplified cleaning of the entire restroom.

2. Description of the Prior Art

Generally speaking, the modern restroom has undergone little variation over the years. A Typical restroom consists of a toilet, a sink, a shower and/or a bath. Some emphasis however, has been placed upon customizing the traditional restroom for special applications.

For example, Painter, U.S. Pat. No. 2,817,091 discloses a mobile sanitary trailer designed for use by large gatherings of people. This invention reflects the traditional restroom on wheels.

Gugler, U.S. Pat. No. 2,037,895 teaches a pre-constructed bathroom designed for easy installation at a building site.

McTighe, U.S. Pat. No. 3,837,011 is a self-cleaning restroom and a method for cleaning a restroom. The sealed restroom disclosed by this invention is cleaned by automatically moving a spray boon around the inside of the enclosure, then draining the fluid, and finally drying the restroom.

In recent years, as the rights of the handicapped have received greater support, restrooms and their components have evolved to become more handicap accessible. A handicap-accessible restroom will typically have wider than ordinary doors which allow a wheelchair to pass through, and at least one oversize toilet stall with a grab bar for use by the handicapped. Truly handicap-accessible restrooms have other features including a ramp or lift device to access the restroom and shower in a wheelchair, and placement of water valves and other restroom accessories at a height by which they may be reached from a wheelchair. Inventors have devised an number of devices to make restrooms more handicap-accessible.

For example, Crump, U.S. Pat. No. 4,757,501 discloses a portable shower stall, platform and ramp combination for use with an invalid's shower chair. This invention permits a handicapped person with an attendant to use an ordinary shower stall.

Maynard, U.S. Pat. No. 4,899,402 is a handicap accessible bathroom which may be easily and modularly installed and removed. This invention may be installed in a pre-existing room, when need exists, and removed when handicapped access is no longer necessary.

Palmeri, U.S. Pat. No. 4,928,329 teaches a bathtub and shower structure for access by the handicapped. This invention is specifically concerned with minimizing the probability that an individual will drown in the bathtub.

Handicap-accessible restrooms have generally met only minimum government requirements for handicap accessibility. What is lacking from the prior art is a truly general purpose restroom suitable for use by the handicapped. The restroom should be provided with the amenities of an ordinary restroom, such as towel hooks and paper towel dispensers, yet be designed so that the amenities may be used by the handicapped. The ordinary handicap-accessible restroom is usually retrofit for that purpose, and as such is not properly designed to have all of its facilities necessarily usable by the handicapped.

Furthermore, at public events, the handicapped are further restricted by a lack of available accessible restroom facilities. Once again, even if such facilities are provided, they are so difficult to use, or dirty, that their use by the handicapped is undignified. One of the reasons that public restrooms become so dirty is the lack of available help to clean them, and the difficulty of cleaning a publicly located restroom. A need exists for a handicap-accessible restroom, particularly a mobile one having the facilities to quickly and efficiently clean the interior of the restroom.

SUMMARY OF THE INVENTION

It is therefore an object of the present invention to provide a restroom facility which is accessible to the handicapped. The restroom should be fully wheelchair accessible with minimum difficulty and have all of its facilities usable by the wheelchair bound or infirm.

Another object of the present invention is to provide a restroom as above including a method and apparatus for conveniently cleaning the restroom. Such a system makes the restroom usable in public locations or at public events. Alternatively, such a system will be useful even in private locations to simplify regular cleanings of the restroom.

A still further object of the present invention is to provide a restroom as above with amenities to make its use by the handicapped convenient and dignified.

These and other objects and advantages of the present invention will become more apparent from the following description.

In order to accomplish the aforementioned and other objects, the present invention discloses a handicap-accessible restroom facility. The restroom includes the traditional restroom elements, a shower portion, a sink portion, and a commode portion.

The shower portion consists of a shower head and a shower hose with a hook on the wall for attaching the shower head. The floor of the shower is integral with the floor of the restroom, thus making it simple to move a wheelchair into the shower. The entranceway to the shower is of ample width to allow wheelchair access.

The commode portion is likewise sized for wheelchair use and access, yet has amenities such as a toilet cover dispenser and sanitary napkin dispenser. In accordance with the other elements of the invention, these dispensers are at a height suitable for wheelchair use.

The sink portion consists of a sink sized for handicapped use, as well as amenities such as a paper towel dispenser and mirror.

Grab bars are provided throughout the restroom to support the handicapped, as are seats provided for the infirm to rest, or be seated during showering. Each seat is equipped with a harness to prevent those sitting from falling down. All necessary controls are within convenient reach of wheelchair bound persons.

The showerhead in the shower portion of the present invention is of sufficient length for water to be sprayed upon all surfaces within the restroom. In practice, when the water is turned on, the shower head is directed about the restroom to clean its dirty surfaces. Water drainage is provided through drain holes in the floor of the restroom. The floor of the restroom is tapered downward toward the drain holes to expedite drying time of the floor and prevent puddling. Thus the restroom is easily cleaned using the existing showerhead.

The restroom is also provided with a wheelchair lift for easy access, and a key entry system to limit access to authorized users.

The temperature of the water to the restroom may be preset to avoid injury to the handicapped. For persons who have trouble discerning dangerous water temperatures, this is an important safety feature. The restroom is also equipped to preset the length of time for which water flow may be turned on. This feature prevents water waste or tampering with the water valves.

The restroom of the present invention becomes even more useful in a mobile configuration. By placing wheels on its bottom, the restroom may be moved to public events. Accordingly, it is equipped with water storage and drainage tanks, as well as a hot water heater and power generator. The restroom thus becomes a fully equipped free-standing handicap-accessible restroom.

DESCRIPTION OF THE PREFERRED EMBODIMENT

Figure 1:
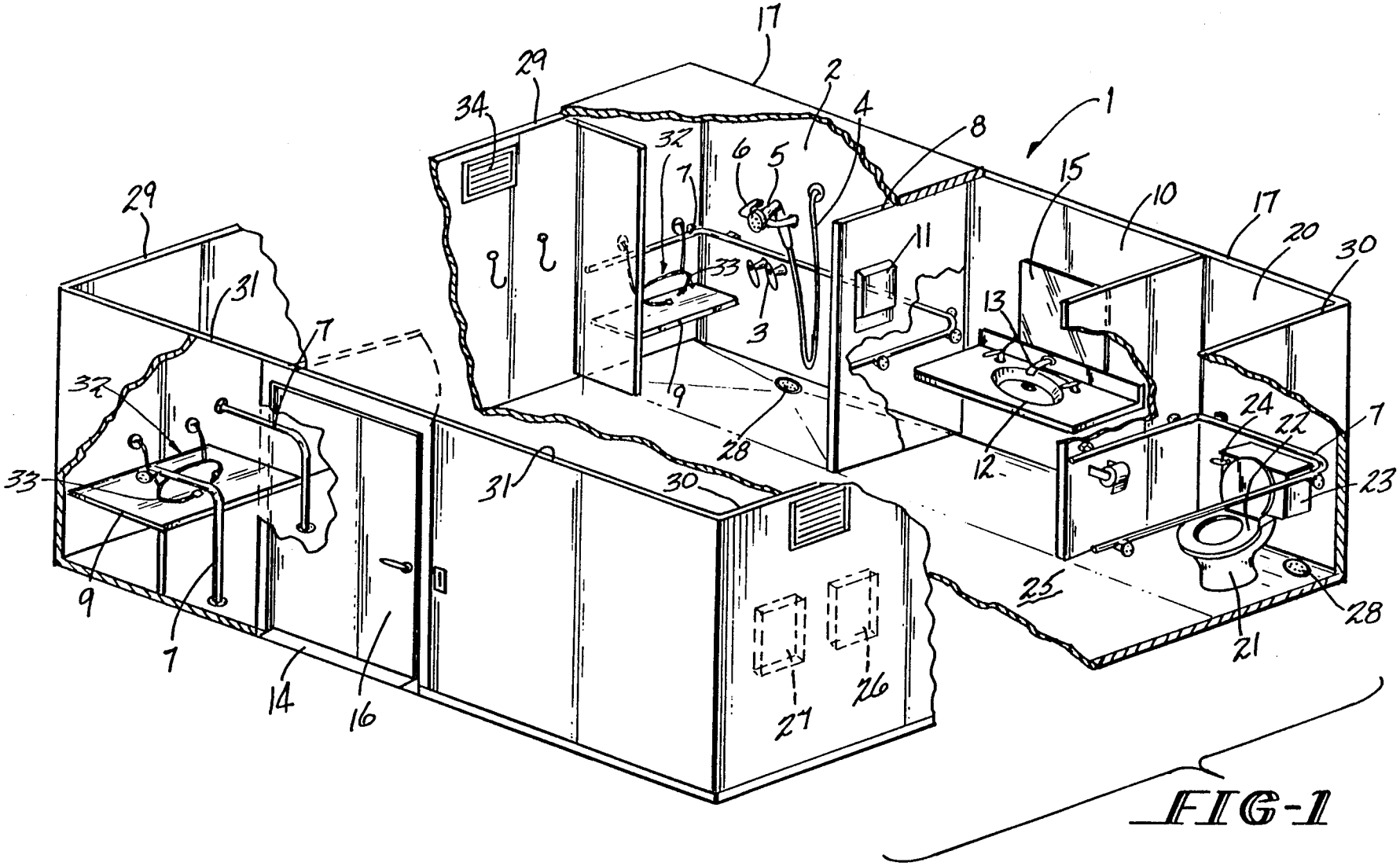
FIG. 1 shows a partial perspective view of the present invention.
Figure 2:
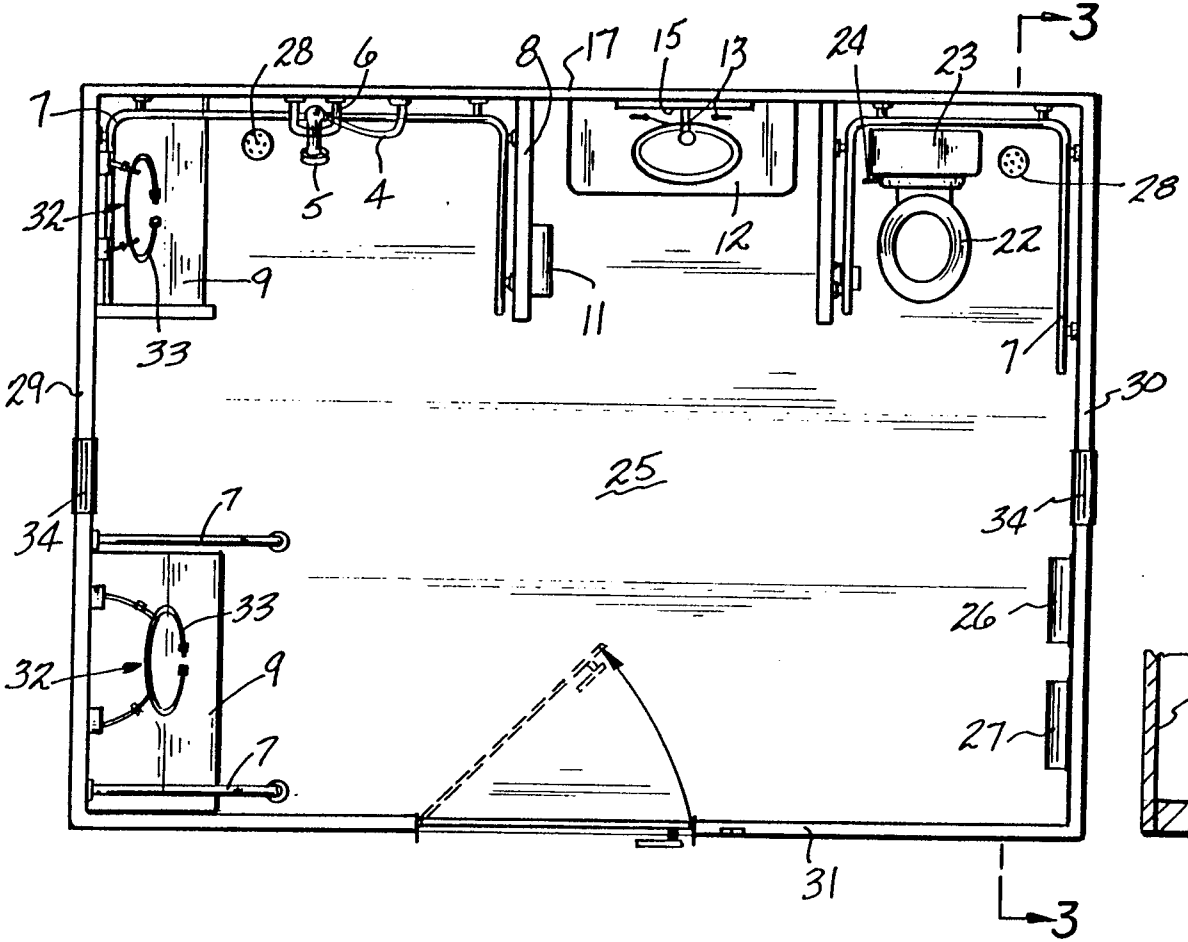
FIG. 2 shows a top view of the invention.

As shown in FIGS. 1 and 2, the restroom (1) of the present invention includes a shower portion (2), a sink portion (10) and a commode portion (20).

In order to enter the restroom (1), an entrance doorway (14) having a door (16) is provided. The entrance doorway (14) is suitably wide to permit unimpeded access to the restroom (1) in a wheelchair. The restroom (1) may also be equipped with an automatic opening door. In this configuration, a button may be pushed either inside or outside of the restroom (1) which will activate an automatic door opening mechanism. This greatly simplifies access to the restroom (1) by those in wheelchairs.

The shower portion (2) of the restroom (1) is in most respects an ordinary shower. It includes at least one valve (3) for initiating the flow of water into the shower and a shower head (5). Also provided is a hose (4) of sufficient length to reach all areas of the interior of the restroom (1). This hose (4) is connected to the pressurized water supply controlled by valve (3) on one end, and on the other end, hose (4) is connected to shower head (5) which directs the outward flow of the water. Shower head (5) may be of the ordinary commercial type, or may be a customized model having therapeutic benefits if desired. Mounted on the wall of shower portion (2) is a hook (6) for supporting shower head (5), and at least one grab bar (7) for supporting handicapped persons. Shower head (5), grab bars (7) and valve (3) are spaced from the floor (25) at a height at which they may be readily grasped by a person seated in a wheelchair. Grab bars (7), for example, are placed approximately 34 inches above floor (25) in a preferred embodiment. This height allows them to be grasped from a wheelchair. The entranceway to shower portion (2) is wide enough to the permit wheelchair access to the shower, and there is no barrier on the floor (25) of the shower entranceway to impede wheelchair use.

Separating sink portion (10) from shower portion (2) is a wall (8). This wall (8) prevents water from splashing from shower (2) and provides a mounting surface for paper towel dispenser (11).

Sink portion (10) consists of an ordinary sink (12), which has at least one valve (13) for moderating the flow of water. Sink (12) may also have a counter top for support or aesthetic purposes and has a drain which is attached to a main drainage system for the entire restroom. Sink portion (10) may also include a mirror (15) mounted to rear wall (17).

Commode portion (20) provides the necessary facilities for the toileting needs of restroom users. Toilet (21) is a wheelchair commode suitable for use by wheelchair bound persons. In a preferred embodiment, the toilet seat (22) of toilet (21) does not exceed 19 inches from floor (25). Toilet (21) also includes tank (23) and flushing lever (24) which are of the type commonly known on toilets. Toilet (21) drains into the restroom's main drainage system and is attached to the restroom's supply of pressurized cold water. Commode portion (20) also contains a toilet seat cover dispenser (26) and a sanitary napkin dispenser (27) mounted on wall (30). These dispensers are located at a height easily accessible to the wheelchair bound. In a preferred embodiment, this height is approximately 26 inches. Additionally, grab bars (7) are mounted on the walls surrounding the toilet (21) for support.

Restroom (1) is equipped with at least one, but preferably two drain holes (28) mounted in the floor (25). In a preferred embodiment, one of these drain holes (28) is located in the shower portion (2), and the other near the base of the toilet (21). The drain holes (28) direct water to the restroom's main drainage system. It is foreseen that additional drain holes (28) may be added, or the drain holes (28) may be relocated if desired.

Figure 3:
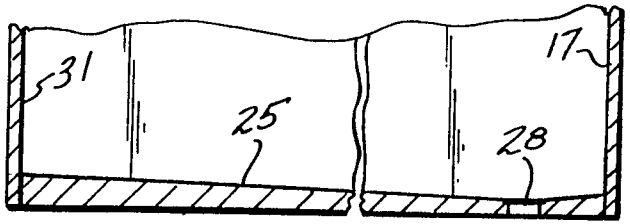
FIG. 3 shows a cross-sectional view of the floor of the restroom through axis 3—3.

As shown in FIG. 3, in order to expedite the draining process, floor (25) is tapered slightly downward toward the drain holes (28). This taper may be relative to either of the axes in the plane of floor (25), or both, depending on the placement of drain holes (28). For example, if drain holes (28) are located near the rear corners of restroom (1) then floor (25) will be tapered downward from front wall (31) to rear wall (17) and from the center of the restroom (1) toward left wall (29) and right wall (30). This configuration assures proper drainage of water and reduced puddling.

Alternatively, rather than tapering floor 25 downward, proper drainage may be achieved by jacking as by jacking the front end of restroom (1) slightly higher than its rear end. Thus a downward taper is nonetheless achieved relative to the ground. In this configuration, restroom (1) may be used on uneven terrain with no degradation of its advantageous cleaning characteristics.

Also provided in restroom (1) are seats (9). These seats (9) are used for temporary resting of persons, or during the showering process. Like the other components of the restroom, seats (9) are of a height readily usable by handicapped persons. In a preferred embodiment, 20 inches is the approximate height of such seats (9).

As invalid people may have difficulty supporting themselves in seats (9), harnesses (32) are provided for support. In a preferred embodiment, harness (32) consists of two strips (33) of a flexible material, each strip

(33) attached firmly at one end to a wall of the restroom (1) or some other strong surface. The other end of each contains a latching means for firmly grasping the other strip (33). For example, the strips (33) may contain on their ends a length of material sold under the trademark VELCRO. A person may be placed in the seat (9), and the harness (32) wrapped around the person and secured. It is anticipated that a single harness (32) would be as effective at supporting a person, and that a variety of latching mechanisms may be used to replace the VELCRO.

Restroom (1), also contains at least one ventilation opening (34). The purpose of ventilation opening (34) is to provide a flow of air to the restroom (1) for cooling, heating, and/or odor release. In a preferred embodiment, ventilation opening (34) extends through the wall in which it is mounted, venting to the outside air. This ventilation opening (34) may be equipped with a lever for opening or closing the vents, or include a fan device for expediting the flow of air. If necessary, restroom (1) may also include an air conditioning and/or heating system.

Figure 4:
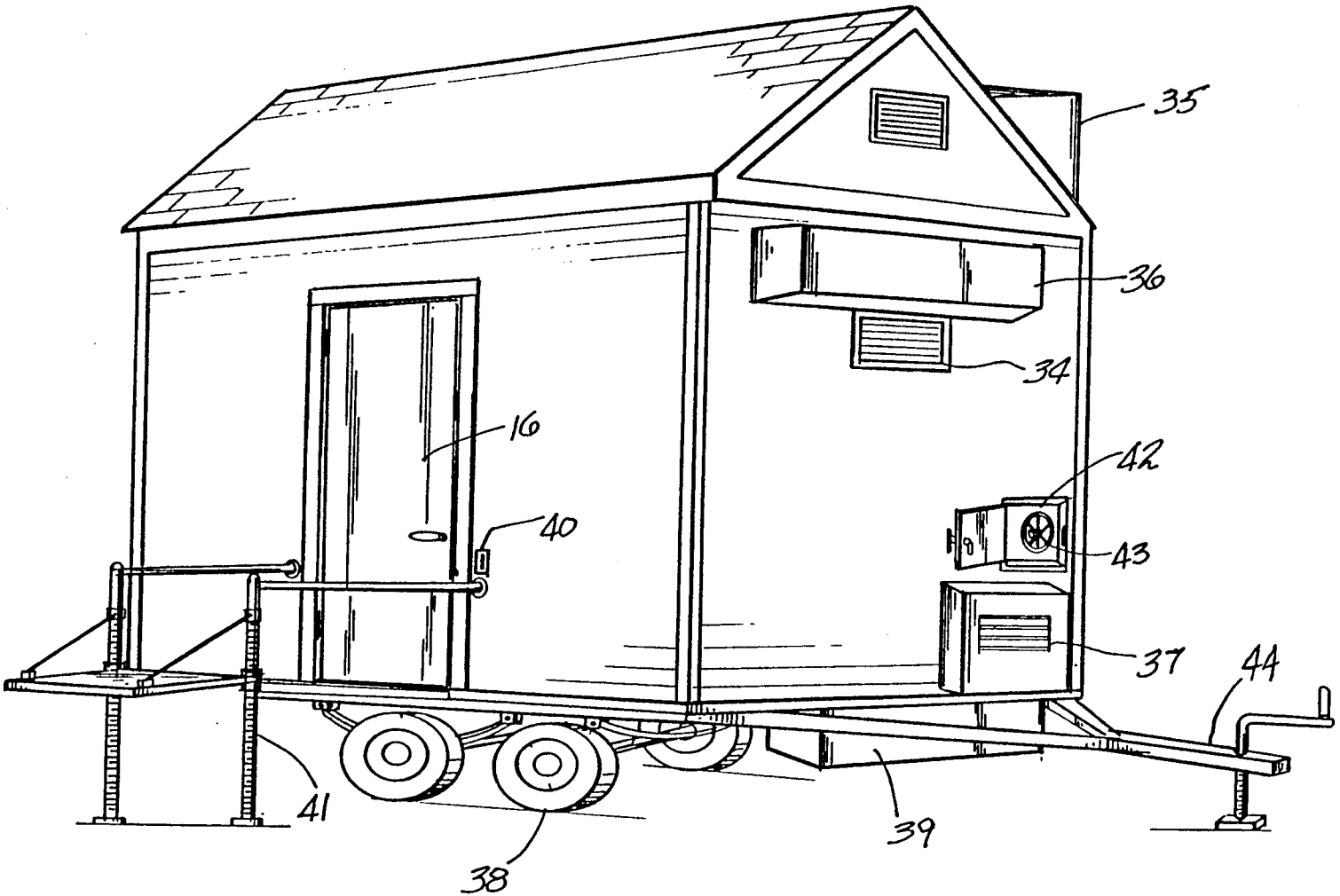
FIG. 4 shows an outside perspective view of the restroom of the present invention.

As shown in FIG. 4, in a further embodiment restroom (1) may be made mobile by equipping it with a means for facilitating movement. For example, restroom (1) may be mounted on wheels (38), so that it may be pulled to a location by another vehicle. In this configuration, restroom (1) may be used as a public restroom, or a temporary restroom facility.

When used in a mobile configuration, restroom (1) includes a tow hitch (44) for attachment to a towing vehicle. Hitch (44) permits restroom (1) to be transported by a separate vehicle to a temporary use location. If desired, hitch (44) may be detachable from restroom (1) for aesthetic purposes. Once the restroom (1) is at a temporary location, hitch (44) may be detached and stored under restroom (1) until such time that it is necessary to move restroom (1) again.

If desired, restroom (1) may be equipped with a mechanism to restrict access to authorized users. For example, a card key reading device (40) could be placed outside of restroom (1). This card key device may read, for example, magnetically coded cards to determine if a person is permitted access to restroom (1). If access were permitted, the card key device controls a locking mechanism on entrance doorway (14).

Also on the exterior of restroom (1), a lift means (41) may be provided for lifting wheelchairs to the entry way level of doorway (14). This eases the accessibility for the handicapped. Particularly in the mobile configuration, wherein the restroom (1) is on wheels, a lift means is very convenient since the restroom (1) may be fairly high off of the ground. Because it is difficult to transport restroom (1) with lift (41) attached, it may be desired to make lift (41) retractable. Lift (41) may then be secured to recessed brackets on the frame of restroom (1) during transportation. In practice, lift (41) is retracted from its use position, then secured under the restroom to the brackets.

If desired, card key reading device (40) may be located on lift (41) and used to initiate a sequence of functions to simplify operation of the restroom. For example, a person entering lift (41) in a wheelchair would insert a magnetic card in reading device (40). This would initiate a cycle which could include; lifting the wheelchair; activating electrical generation, the lighting and climate control systems in restroom (1), initiate water pumping and pressurization, opening the restroom door; and hot water heating. In a preferred embodiment, all of these functions are controlled by a solid state control system and begin operation when a magnetic card is placed in reading device (40). When the magnetic card is withdrawn, restroom (1) effectively turns itself off. This configuration is highly energy and cost efficient and assures maximization of the limited storage and energy producing resources of the restroom.

As certain handicapped persons may be unable to discern the temperature of the water coming from the shower or the sink, perhaps due to lack of feeling in their extremities, restroom (1) is provided with a means for presetting the temperature of the water supply to the shower portion (2) and/or sink (12). Such preset temperature water may help avoid burns which may result from improper adjustment of a conventional mixing type valve. The temperature setting valve (43) must be located where it may not be tampered with, and access to this valve must be restricted. In a preferred embodiment, valve (43) is located in a lockable box (42) on the outside of the restroom (1). However, this temperature setting means need only be located in any inaccessible location. This valve (43) permits water having a preset temperature to be supplied to the sink, shower, or both. Since the water is at a preset temperature, any device using such water needs only a valve with on and off settings, not a conventional mixing type valve.

Also provided in the restroom is a means for timing the cycle of water flow through either the sink or shower. In order to provide this feature, shower valve (3) and/or sink valve (13) may be a type of valve which shuts itself off after a preset time cycle. In this configuration, when a valve is actuated, water flow continues for the length of the preset time of the cycle. Upon completion of the cycle, water flow is terminated. It is anticipated that many possible configurations exist for the use of preset temperature water and timed cycles in the sink and shower, and the use of various valve types including on-off valve, mixing valve, timed cycle valve etc. Use of timed cycle valves and preset temperature water in the restroom may prevent burn and flooding accidents.

Finally, since the restroom may be used in fixed locations or portable applications, it may include a water tank (35) to hold water for use in the various components of the restroom (1). Since the restroom (1) requires that its water supply be pressurized, a means for pressurizing the water is necessary. This may be provided by a pump, or by mounting the water tank (35) at a height above the restroom elements and using the force of gravity to pressurize it. A water tank and heater (36) is also provided for heating the water, and a waste tank (39) receives the drainage water from the main drainage system of the restroom (1). A jet pump may be used to pump the waste water to the waste tank. Finally, restroom (1) includes a generator (37) for generating electrical power to drive the various electrical devices present in the restroom, and to provide power for electrical outlets. Gas tanks are also provided to store fuel for restroom operation. Generally, gasoline is used to provide energy for the electrical generator (37) and liquefied propane is used for hot water heating. These various components may be placed either external to the restroom or in a utility room adjacent to or integral with the restroom. An access door which opens to the outside of the building may then be provided for access. In the mobile configuration, these elements would make the restroom (1) completely free standing, and suitable for use at public events.

In order to reduce the damage due to fire in the restroom (1), a fire suppression system may be provided. Such a system would detect heat build-up thin the restroom, and suppress a fire when detected by releasing a fire suppressant. Additionally, the suppressing system could automatically turn off the generator and heating systems if desired.

Since the restroom of the present invention is intentionally designed with handicap usable amenities, it is foreseen that the restroom (1) may include grab bars, towel racks, hooks, seats, or other convenience items spaced throughout the restroom.

It is foreseen that the restroom (1) may be used in a variety of configurations having all or a subset of the features disclosed as indicated in the following examples.

If it were desired to have handicap-accessible restrooms at a public event, for example, separate mens and ladies rooms could be provided. These units however, would not require showering facilities. It might also be advantageous to provide a tank separate from the two restrooms to supply water to both of them.

Recent Government regulations have required that universities provide handicap-accessible dormitories. Since it is sometimes prohibitively expensive to retrofit existing buildings for handicap access, the restroom could be enhanced to perform as a handicap-accessible mobile home. A separate living section including sleeping area, kitchen, and climate controls could be added adjacent to the restroom. Thus a college seeking to add handicap dormitories need only transport such mobile handicap homes to a resting site to provide timely, inexpensive, handicap-accessible college housing.

In practice, the restroom is easily cleaned using the hose (4) and shower head (5) combination. The valve (3) in the shower is actuated, beginning the flow of pressurized water through the hose (4) and the shower head (5). This water is sprayed on the unclean surfaces of the restroom to remove any contaminants thereon. The shower head (5) is then moved to clean other surfaces. The drainage water from the cleaning process then flows from the surfaces, to the tapered floor (25), and proceeds through the drain holes (28). When cleaning is complete, the shower head (5) is replaced on its hook (6) in the shower where it may now be used for showering, and the water flow terminated at the valve (3).

Although the invention has been described in detail with respect to certain embodiments and examples, variations and modifications exist which are within the scope of the invention as defined in the following claims.

What is claimed is:

1. A mobile handicap accessible restroom facility comprising:

a floor and vertical walls extending from the floor;

a sink portion in said facility sized for use by wheelchair bound persons;

a commode portion in said facility sized for use by wheelchair bound persons;

an entrance door to said facility sized to allow passage of a wheelchair therethrough;

at least one drain hole spaced along said floor;

a shower portion in said facility sized to permit wheelchair access, having a shower wall and a shower head detachably secured thereto;

wherein said sink portion, commode portion and shower portion are affixed to the vertical walls;

a pressurized supply of water to said restroom;

a hose attached to said shower head and to said pressurized water supply;

said hose having a length sufficient to allow said shower head to reach all areas within said restroom for cleaning purposes;

said floor being tapered downward in a direction toward said at least one drain hole; and means for facilitating movement comprising mounting said restroom on a plurality of wheels and including a hitch associated therewith.

2. A handicap accessible restroom according to claim 1 further comprising a plurality of grab bars mounted on the walls therein to support handicapped persons.

3. A handicap accessible restroom according to claim 1 including a valve for presetting the temperature of the pressurized water supply.

4. A handicap accessible restroom according to claim 3 including means for restricting access to said valve.

5. A handicap accessible restroom according to claim 4 wherein said means for restricting access comprises mounting said valve external to the walls of said restroom.

6. A handicap accessible restroom according to claim 3 further comprising timing means for terminating a flow of said pressurized water to said shower after a preset cycle time.

7. A handicap accessible restroom according to claim 1 including at least one seat in said facility having dimensions suitable for use by handicapped persons.

8. A handicap accessible restroom according to claim 7 including means for securing a person on said seat.

9. A handicap accessible restroom according to claim 8 wherein said means for securing comprises a harness formed from two flexible strips each having and end fixedly secured to a wall of said restroom, and a free end; and means for attaching the free ends of said strips.

10. A handicap accessible restroom according to claim 1 further comprising means for ventilating said restroom.

11. A handicap accessible restroom according to claim 10 wherein said means for ventilating comprises at least one opening in a wall of said restroom for the passage of air.

12. A handicap accessible rest room according to claim 1 further comprising;

a waste water tank connected to a drainage system of said restroom; and means for generating electrical power to supply to said restroom.

13. A handicap accessible restroom according to claim 1 further comprising means to restrict access to said restroom.

14. A handicap accessible restroom according to claim 13 wherein said means to restrict access comprises a card key reading and door unlocking means located external to said restroom.

15. A handicap accessible restroom according to claim 1 further comprising lift means located external to said restroom for providing wheelchair access to said restroom.

16. A handicap accessible restroom according to claim 1 wherein said pressurized water supply comprises:

a water tank containing water;

means for pressurizing said water;

means for heating said water; and means for supplying said water to said restroom.

17. A handicap accessible restroom according to claim 1 wherein said sink portion, commode portion and shower portion are affixed to the same vertical wall.

18. A handicap accessible restroom according to claim 1 including at least two drain holes spaced along said floor and wherein said floor is tapered towards said at least two drain holes.

* * * * *